US007382223B2

(12) United States Patent
Krishnamurthy et al.

(10) Patent No.: US 7,382,223 B2
(45) Date of Patent: Jun. 3, 2008

(54) THERMAL CIRCUIT BREAKER

(75) Inventors: Anand Krishnamurthy, Norwood, MA (US); Stephen J. Bryant, Coventry, RI (US); William J. Bentley, Jr., North Attleboro, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 262 days.

(21) Appl. No.: 11/284,169

(22) Filed: Nov. 21, 2005

(65) Prior Publication Data

US 2007/0115089 A1 May 24, 2007

(51) Int. Cl.
*H01H 37/52* (2006.01)
*H01H 37/02* (2006.01)

(52) U.S. Cl. ..... 337/72; 337/53; 337/91

(58) Field of Classification Search ..... 337/72, 337/53, 68, 91, 89, 111
See application file for complete search history.

(56) References Cited

U.S. PATENT DOCUMENTS

| | | | | |
|---|---|---|---|---|
| 3,288,967 | A | 11/1966 | Perry | |
| 5,004,994 | A | 4/1991 | Korczynski et al. | |
| 5,021,761 | A | 6/1991 | Stack et al. | |
| D321,339 | S | 11/1991 | Stack et al. | |
| D322,960 | S | 1/1992 | Stack et al. | |
| D357,669 | S | 4/1995 | Stack et al. | |
| 5,790,010 | A * | 8/1998 | Schwab | 337/365 |
| 5,828,284 | A * | 10/1998 | Huang | 337/37 |
| 5,861,794 | A | 1/1999 | Pellon | |
| 6,229,426 | B1 * | 5/2001 | Lavado et al. | 337/57 |
| 6,480,079 | B1 * | 11/2002 | Bentley et al. | 335/6 |
| 6,522,228 | B2 * | 2/2003 | Wellner et al. | 335/18 |
| 6,538,549 | B1 | 3/2003 | Renne et al. | |
| 6,542,056 | B2 * | 4/2003 | Nerstrom et al. | 335/17 |
| 6,577,221 | B1 * | 6/2003 | Wang | 337/59 |

(Continued)

FOREIGN PATENT DOCUMENTS

EP 409611 A2 * 1/1991

*Primary Examiner*—Anatoly Vortman
(74) *Attorney, Agent, or Firm*—Russell E. Baumann

(57) ABSTRACT

A switchable thermal circuit breaker (10) has an automatically resettable, current carrying thermostatic disc (14) cantilever mounted in a housing (12) and carries a movable contact (14*b*) into and out of electrical engagement with a stationary contact (14*c*). A disc coupling member (16) is pivotally mounted above the disc and has fingers (16*e*, 16*f*) to capture opposed sides of the disc so that the disc coupling member pivots concomitantly with movement of the disc. A radially extending blade (18*c*) of a pivot member is biased by a spring (18*k*) into engagement with a stop surface (16*k*) of the disc coupling member when the contacts are in the engaged position and is movable under the stop arm (16*g*) when the disc moves to the contacts disengaged position to prevent reengagement of the contacts. Also, mounted on an end of the pivot body is a reset lever and indicator flag (18*h*) that moves to a position indicative of the contacts disengaged position and can be moved, against to the bias of the spring, to a position in which the blade is moved from under the stop arm to allow the disc to move to the contacts engaged position, assuming the disc is at a suitable temperature. According to a feature of the invention, a pushbutton (24) can be provided to apply a force to the disc coupling member causing it to pivot in a contacts opening direction to manually switch the circuit breaker to the open circuit position.

10 Claims, 5 Drawing Sheets

U.S. PATENT DOCUMENTS 6,590,489 B1 * 7/2003 Ullermann et al. ..... 337/56
6,642,832 B2 * 11/2003 Pellon et al. ..... 337/66
6,707,368 B2 * 3/2004 Alfaro et al. ..... 337/56
6,744,345 B2 * 6/2004 Korczynski et al. ..... 337/358
6,876,290 B2 * 4/2005 Yu ..... 337/59
7,034,650 B2 * 4/2006 Yu ..... 337/59
7,298,239 B2 * 11/2007 Yamada ..... 337/107
7,317,375 B2 * 1/2008 Yu ..... 337/94

* cited by examiner

THERMAL CIRCUIT BREAKER

FIELD OF THE INVENTION

This invention relates generally to electrical circuit breakers and more particularly to circuit breakers using snap-acting, current carrying thermostatic discs.

BACKGROUND OF THE INVENTION

It is conventional to mount a current carrying thermostatic disc in a housing so that it will snap between contacts engaged and contacts disengaged configurations in dependence upon the temperature of the disc. Such circuit breakers are used in many applications, for example, in marine and off-load trucking. Electrical current passing through the disc generates heat thereby raising the temperature of the disc. Current levels above a selected level will raise the temperature of the disc to a preselected actuation level at which point the disc will snap to a contacts disengaged configuration thereby breaking the electrical circuit until the disc cools off to a lower, reset temperature at which point the disc will automatically snap back to a contacts engaged configuration re-energizing the electrical circuit.

Another circuit breaker in commercial use employs an automatically resettable disc along with an electrically insulative, spring loaded member which, upon opening of the contacts, moves between the contacts to thereby prevent reengagement of the contacts. The circuit breaker is manually reset by moving the member out of alignment with the contacts. This type of circuit breaker has the disadvantage that the plastic member that drags across the contacts is subjected to arcing and tends to melt and/or deteriorate and contaminate the contacts during repeated cycling thereby adversely effecting proper operation.

SUMMARY OF THE INVENTION

It is an object of the present invention to provide a manually resettable circuit breaker that is not subject to the limitations of the prior art noted above.

It is another object of the present invention to provide a switchable feature for a calibration free thermal circuit breaker so that the breaker can be caused to move to the open circuit position as a result of a manual intervention as well as by an overload condition during operation thereof.

Another object of the invention is to provide a circuit breaker that has structure indicative of whether the device is in the open or closed circuit position and one that has a manual reset capability. Yet another object is the provision of a thermal circuit breaker that has high rupture performance, one that can be easily assembled and one that is tease free for the opening operation. Still another object is the provision of a manual reset mechanism that is not susceptible to arcing problems of the above noted prior art.

Briefly in accordance with a preferred embodiment of the invention, a manually resettable thermal circuit breaker comprises a cantilever mounted thermostatic snap-acting disc that mounts a movable electrical contact at a free end thereof and is movable into and out of engagement with a stationary electrical contact. A disc coupling member is pivotally mounted above the disc and is provided with two pair of laterally aligned first and second vertically spaced apart fingers that are arranged to receive between each pair of fingers respective opposite sides of the disc so that the disc and the disc coupling member move together as a unit.

Preferably, the fingers are laterally aligned with that portion of the disc that mounts the movable electrical contact.

A combined status indicator and reset mechanism is mounted adjacent to the disc coupling member. The indicator and reset mechanism includes a pivot member having an axis of rotation generally normal to the plane in which the disc lies. The pivot member has a radially extending blade that is biased to a first position in engagement with a stop surface of an arm of the disc coupling member, also in a first position, when the electrical contacts are in the engaged position and, upon disengagement of the electrical contacts, to a second position beneath the arm having the stop surface with the arm moving upwardly to a second position due to the connection of the fingers with the disc to thereby prevent reengagement of the electrical contacts until the blade is moved from under the arm having the stop surface. A combination reset lever and indicator flag is mounted on the pivot member with the pivot member extending through an aperture in the housing so that the reset lever and indicator flag is exposed. The reset lever and indicator flag may be disposed under a covering structure on the housing when in the engaged contacts position and exposed when the blade moves to the second contacts disengaged position. The device can be reset manually by moving the reset lever of the pivot member so that the radially extending blade is concomitantly moved back beyond the stop surface with the disc then free to move to the contacts engaged position, the fingers of the disc coupling member bringing the disc coupling member and hence the arm having the stop surface into its first position.

In applications in which it is also desired to provide manual switching, a pushbutton may be mounted on the housing and adapted to transfer motion to a portion of the disc coupling member that is disposed on a side of the axis of rotation of the disc coupling member opposite to the side having the pairs of the fingers so that the actuation of the pushbutton will cause the disc coupling member to pivot thereby lifting the fingers and stop surface along with the free end of the disc and allow the blade to move under the arm having the stop surface and the reset lever and indicator flag to the exposed position. The electrical contacts can then be reengaged by turning the reset lever back to the contacts engaged position.

BRIEF DESCRIPTION OF THE DRAWINGS

Other objects, advantages and details of the invention appear in the following detailed description of the preferred embodiments, the detailed description referring to the drawings in which like reference characters refer to like components or structural features throughout the several views of the drawings.

Figure 1:
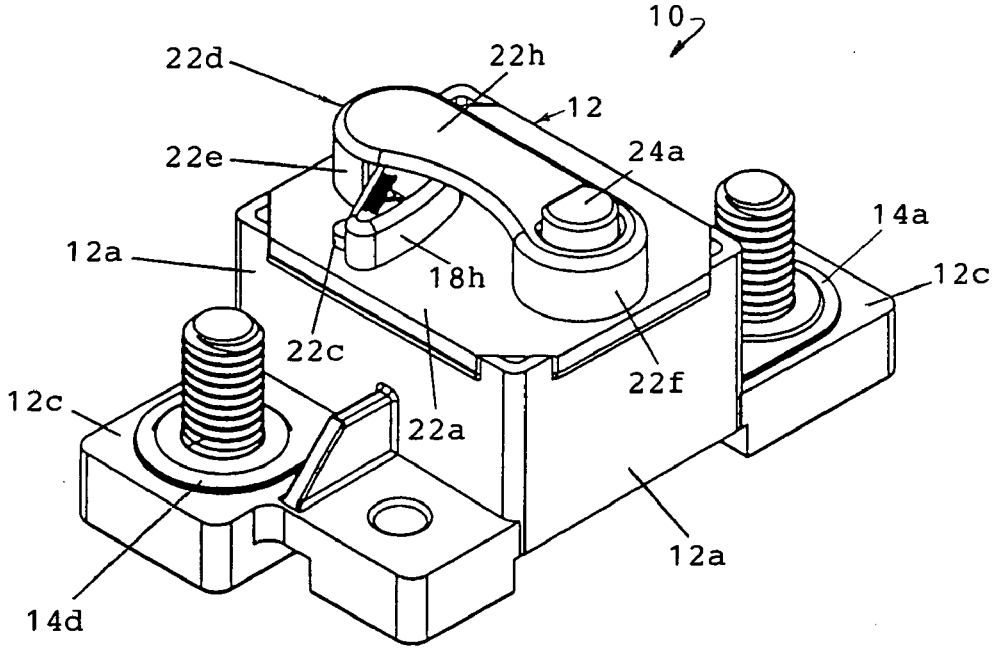
FIGS. 1 and 2 are perspective views of a switchable thermal circuit breaker made in accordance with a preferred embodiment of the invention shown respectively in the circuit open, contacts disengaged position and the circuit closed, contacts engaged position.
Figure 2:
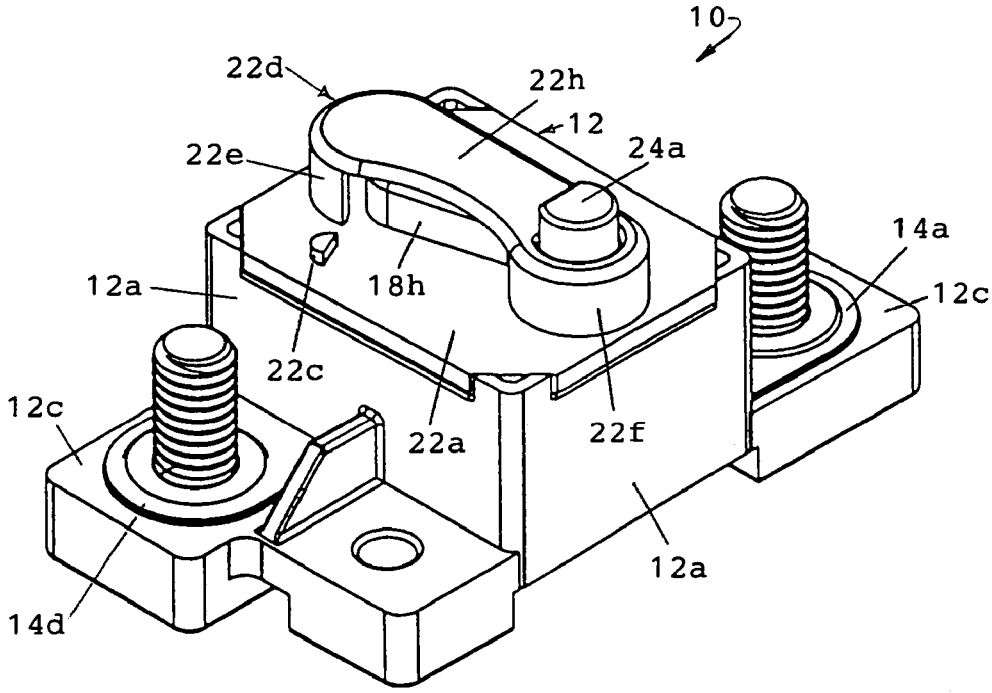

IN THE DETAILED DESCRIPTION OF PREFERRED EMBODIMENTS:

Manually resettable, circuit breaker 10 is shown in the open circuit, reset position in FIG. 1 with reset indicator flag exposed and in the closed circuit position in FIG. 2 with the reset flag in the covered position. Circuit breaker 10 comprises a housing 12 having side walls 12*a*, bottom wall 12*b* (FIG. 5) and laterally extending attachment flanges 12*c* on two opposed sides of the housing.

Figure 3:
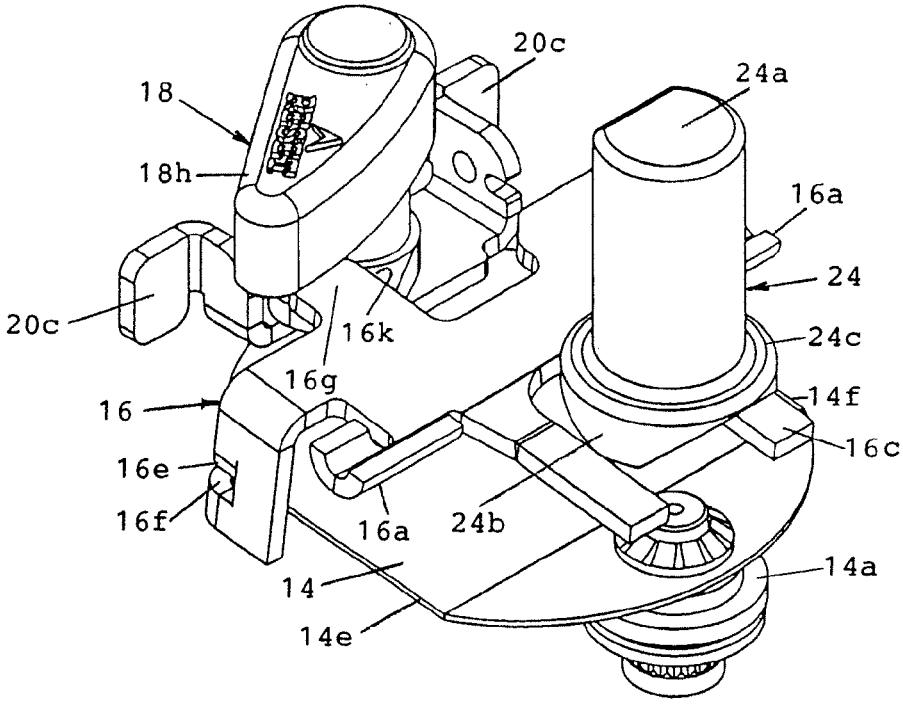
FIGS. 3 and 4 are perspective views corresponding respectively to FIGS. 1 and 2 with the circuit breaker housing removed for purposes of illustration.
Figure 4:
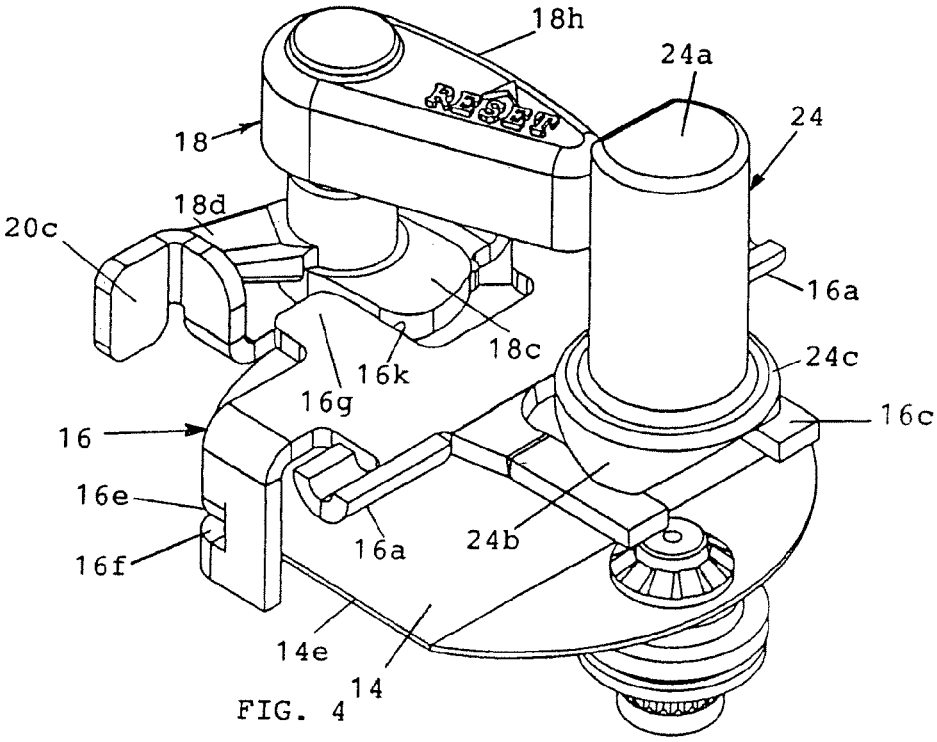
Figure 5:
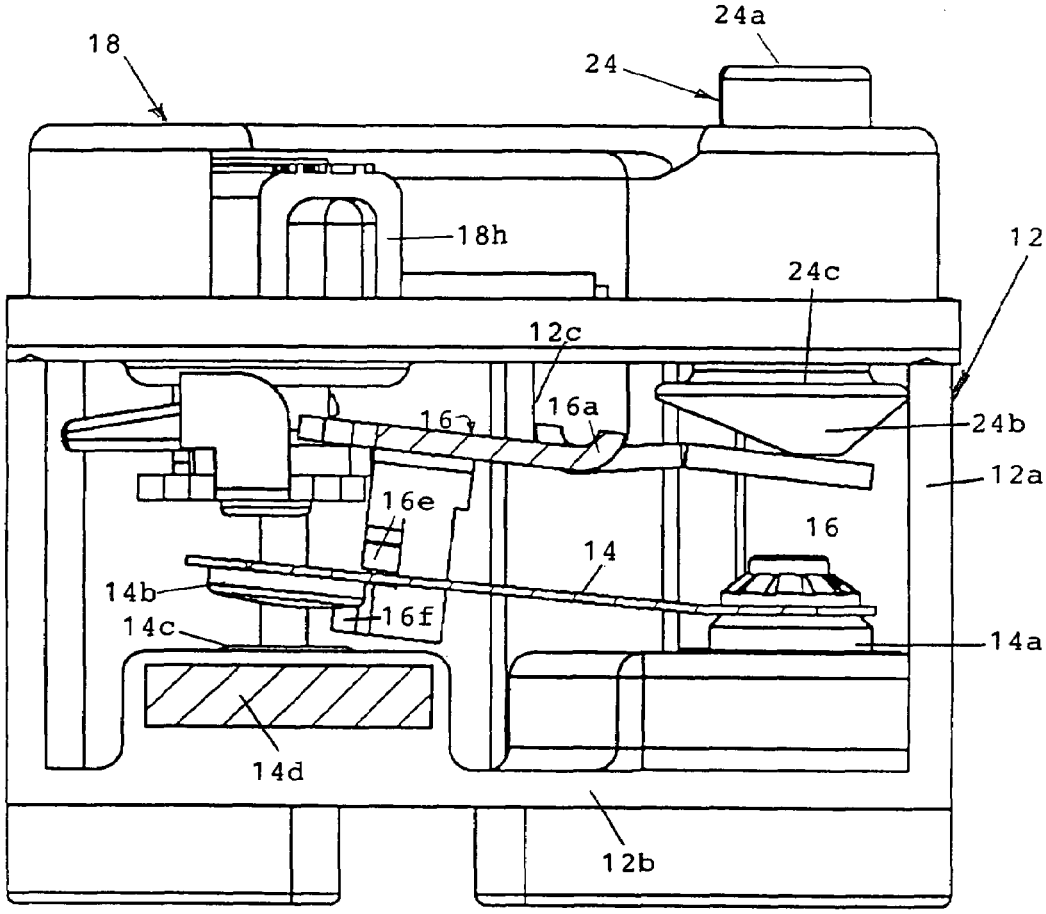
FIG. 5 is a partial cross sectional elevational view taken generally parallel to the longitudinal axis of a cantilever mounted thermostatic disc mounted in the breaker (in the contacts disengaged position)
Figure 10:
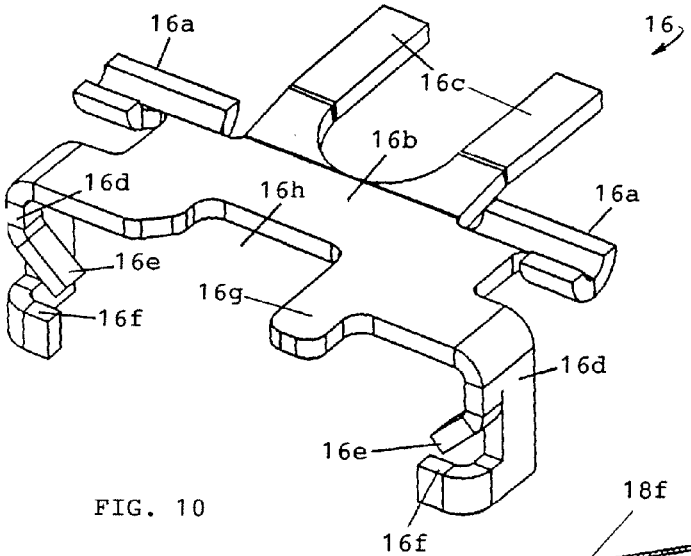
FIG. 10 is a perspective-view of the disc coupling member of the FIGS. 1, 2 circuit breaker.

With particular reference to FIGS. 3-5, a snap acting, current carrying, automatically resettable, thermostatic disc 14 is cantilever mounted to terminal 14*a*. A movable electrical contact 14*b* is mounted on the free end of disc 14 and is adapted to move into and out of electrical engagement with stationary electrical contact 14*c* electrically connected to terminal 14*d*. Thermostatic disc 14, at normal ambient temperatures, is in the closed circuit, contacts engaged position when reset indicator flag 14*a* is in the FIG. 2 position, however, upon overheating caused by an overload condition such as overcurrent, the disc snaps to an open circuit, contacts disengaged position as shown in FIGS. 1 and 5. As best seen in FIGS. 5 and 10, disc coupling member 16 is pivotally mounted in housing 12 overlying disc 14. Disc coupling member 16 has first and second rounded pivot arms 16*a* extending laterally from opposite sides of body 16*b* that are pivotally received in respective slots 12*c*, formed in two opposed side walls 12*a*, one slot being shown in FIG. 5. As used in this context, laterally refers to a direction generally normal to the longitudinal axis of disc 14, that is, a direction between the front 14*e* and the back 14*f* sides of disc 14 as seen in FIGS. 3 and 4. Also, projecting from the opposite sides of body 16*b* of disc coupling member 16 are first and second grabber arms 16*d* that extend downwardly, as seen in FIG. 10, and are each formed with inwardly extending, spaced apart, upper 16*e* and lower 16*f* fingers. Each pair of fingers 16*e*, 16*f* is located so that opposite sides of disc 14 can be inserted between respective pairs of fingers, preferably at a location that is laterally aligned with the movable electrical contact. The vertical spacing between the fingers of each pair is selected to accommodate typical thicknesses of thermostat metal discs, for example, between 0.020 and 0.050 inch spacing for discs of 0.010 to 0.035 inch thickness. The disc coupling mechanism is freely pivotable and therefore moves with the disc between engaged and disengaged positions of the contacts due to the coupling to the disc by means of the fingers.

The disc coupling member is also formed with stop arm 16*g* that extends from body 16*b* in a direction away from the axis of rotation of pivot arms 16*a* toward the free end of disc 14 for a purpose to be described below.

Figure 9:
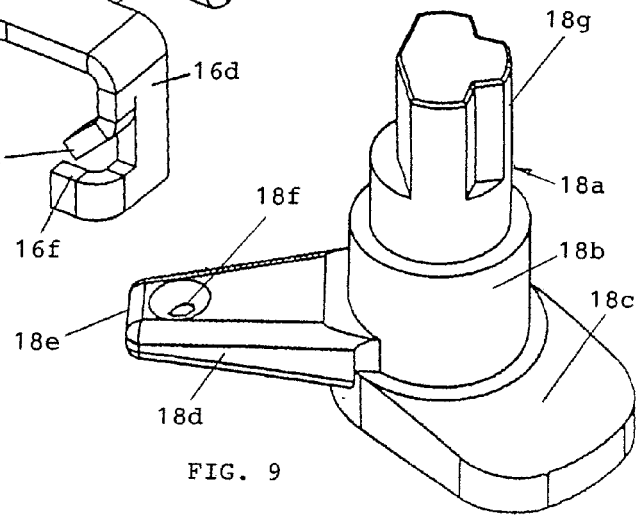
FIG. 9 is a perspective view of the pivot member.

Reset mechanism 18, best seen in FIG. 9, includes a pivot member 18*a* having a generally cylindrical body 18*b* having in turn a cylindrical portion (not shown) extending downwardly from the body that is rotatably received in aperture 20*a* of bracket 20 that rotatably supports pivot member 18*a* in housing 12. Bracket 20, in turn, is formed with tabs 20*c* that are received in suitable recesses (not shown) in housing 12. Pivot member 18*a* has a radially extending blade 18*c* of any suitable material extending in a first angular direction and a spring attachment arm 18*d* extending radially in a second angular direction. Spring attachment arm 18*d* has a free end 18*e* formed with a spring attachment hole 18*f* through the arm at the free end thereof. The top portion 18*g* of body 18*b* is configured to interlock with reset lever and indicator flag 18*h* shown, for example, in FIGS. 3-5.

Figure 6:
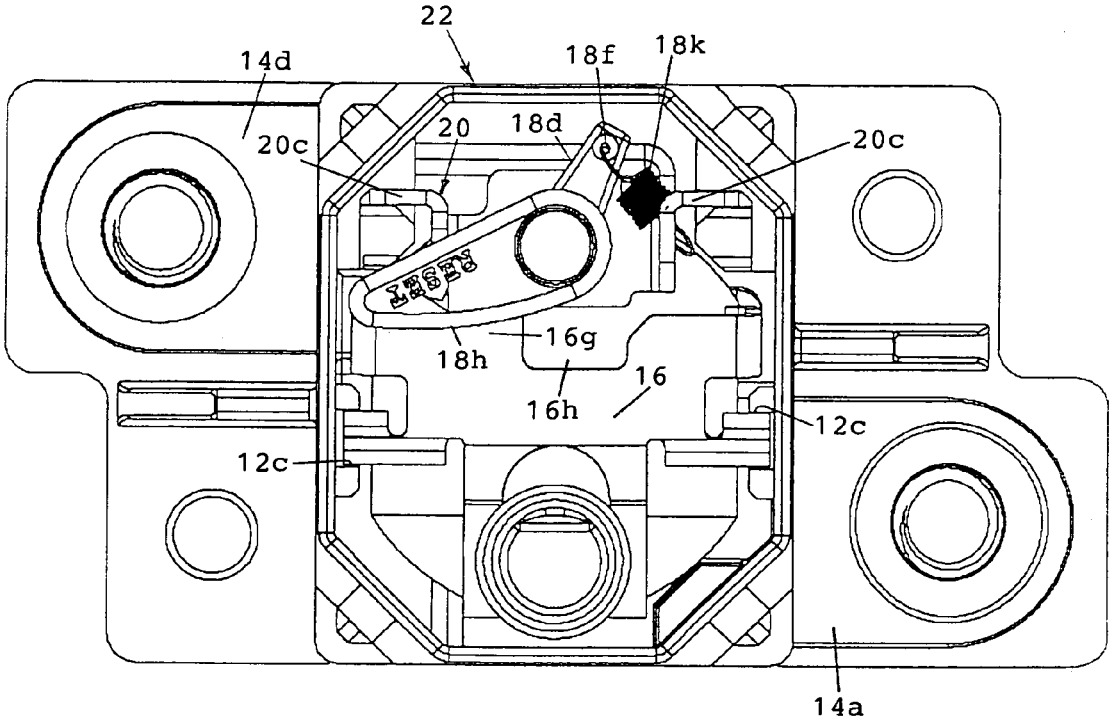
FIG. 6 is a top plan view of FIG. 1 with the top wall of the housing removed for purposes of illustration.

Reset mechanism 18 is mounted generally aligned with the longitudinal axis of disc 14 and spaced above and adjacent to the free end of the disc with blade 18*c* capable of extending into cut-out portion 16*h* of the disc coupling member 16. Suitable spring means, such as coil spring 18*k* has one end attached to spring attachment hole 18*f* (see FIG. 6) and its opposite end attached to bracket 20 at spring attachment hole 20*b* placing a clockwise bias on the reset mechanism as viewed in FIG. 6. In the closed circuit or engaged contacts, first position, blade 18*c* is biased against side 16*k* (stop surface) of stop arm 16*g* of disc coupling member 16 also in its first position. Upon disengagement of the contacts, however, blade 18*c* moves under stop arm 16*g* as a result of the spring bias placed on spring attachment arm as the free end of the disc and the stop arm move upwardly to their respective second positions thereby preventing reengagement of the contacts. Reengagement of the contacts is effected by manually pivoting reset lever and indicator flag 18*h* in a counterclockwise direction against the bias of spring 18*k* and that in turn moves blade 18*c* from beneath stop arm 16*g* allowing the disc coupling member 16 to pivot as disc 14 resets to its closed circuit position when it is sufficiently cool, i.e., when the temperature of the disc is at or below the reset temperature.

Figure 7:
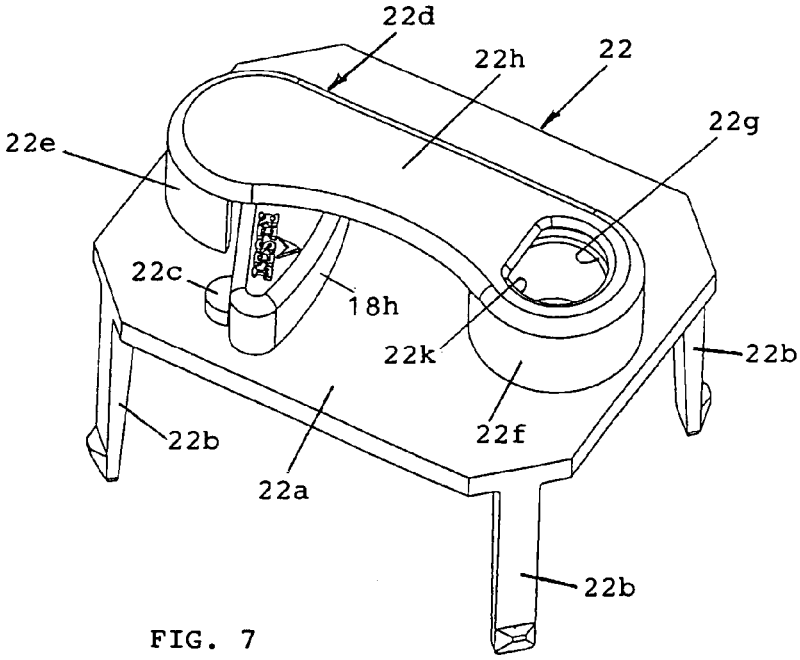
FIG. 7 is a perspective view of the top cover assembly of the FIGS. 1 and 2 circuit breaker in the FIG. 1 position.
Figure 8:
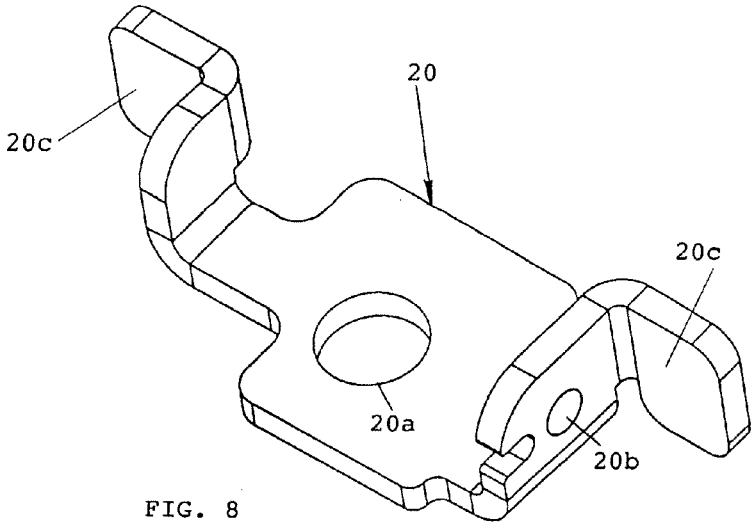
FIG. 8 is a perspective view of a bracket used to mount the pivot body of the reset/indicator assembly of the FIGS. 1, 2 circuit breaker.

With particular reference to FIG. 7, cover assembly 22 is received on the free distal end of housing side walls 12*a*, shown in FIGS. 1 and 2. The four corners of top wall 22*a* are cut back to interfit with cut-out portions 12*d* of side walls 12*a* and the top wall is provided with depending legs 22*b* provided at each corner that are snap fitted within side walls 12*a*. It will be realized that, if desired, instead of a snap assembly, the cover assembly could be held in place with conventional fasteners, such as rivets.

The top portion of body 18*b* of the reset mechanism 18 is received through an aperture (not shown) in top wall 22*a* with reset lever and indicator flag 18*h* then installed on the interlock configuration 18*g*. An over-travel stop member 22*c* may be mounted on top wall 22*a* to limit pivotal motion of the reset lever and indicator flag.

A generally u-shaped enclosure 22*d* is disposed on top wall 22*a* and has a hub-like first leg 22*e* received around the circular end portion of the reset lever and indicator flag aligned with body 18*b* of the reset mechanism 18. Another hub-like second leg 22*f* is received over a second aperture 22*g* in top wall 22*a* and a bight portion 22*h* extends between legs 22*e*, 22*f* and is spaced above top wall 22*a* a distance sufficient to accommodate reset lever and indicator flag 18*h*. Thus, reset lever and indicator flag 18*h* is aligned with bight portion 22*b* when the circuit breaker is in the contacts engaged position with the top surface of the reset lever and indicator flag covered (see FIG. 2) and is in an exposed position showing the reset lever and indicator flag when the circuit breaker is in the contacts disengaged position (see FIG. 1) and facilitating resetting motion by manually pivoting the reset lever and indicator flag.

According to a feature of the invention, if desired, a contacts opening mechanism can be incorporated in the device. As seen in FIG. 7, the top wall of hub 22*f is* formed with an aperture 22*k* aligned with aperture 22*g* in top wall 22*a*. Preferably, aperture 22*k* is formed with an orientation surface, such as straight line portion 22*m* and receives therethrough a pushbutton 24 having an end top portion 24*a* configured to be slidingly received in aperture 22*k* and an opposite end having force transfer portion 24*b* and an intermediate enlarged diameter portion 24*c* that acts as a stop surface preventing the pushbutton from escaping from hub 22*f*. Pushbutton 24 is aligned with spaced apart legs 16*c* that extend from the pivot axis of pivot arms 16*a* of disc coupling member 16. This structure provides the capability of opening the contacts from a contacts engaged position by pushing down on pushbutton 24 that causes disc coupling member to pivot clockwise, as seen in FIGS. 3 and 4 from the FIG. 4 position to the FIG. 3 position with fingers 16*f* applying a contacts opening force to disc 14. Upon this pivotal motion of disc coupling member 16 and concomitant upward movement of stop arm 16*g*, blade 18*c* moves under the stop arm due to the spring force of spring 18*k* to prevent reengagement of the contacts until reset lever and indicator flag 18*h*, that has moved from under bight 22*h* to the exposed position, is pivoted back to the reset position beneath bight 22*h*.

It will be understood that, if desired, force application means other then pushbutton 24 could be used, such as a rocker assembly. Further, in certain applications, if the manual opening feature is not desired then the pushbutton or comparable structure, can be omitted from the device. Although environmental seals have not been shown or described, if desired, conventional sealing means can be provided.

The circuit breaker of the invention provides high rupture performance and tease free engagement (close) and disengagement (open) operations yet is easily assembled.

Although the present invention has been described with reference to certain preferred embodiments, it should be appreciated that various other modifications and adaptations can be made without departing from the scope of the invention as defined by the claims.

What is claimed:

1. A thermal circuit breaker comprising:

a housing, a stationary electrical contact, a cantilever mounted thermostatic disc having a length and having a free end, a movable electrical contact mounted on the free end of the thermostatic disc and movable into and out of engagement with the stationary contact, a disc coupling member having a pivot for pivotally mounting the disc coupling member in the housing above the thermostatic disc, the disc coupling member having a first leg extending away from the pivot toward the free end of the thermostatic disc in a first direction aligned with the length of the thermostatic disc, an arm depending downwardly from the disc coupling member on the first direction side of the disc coupling member toward the thermostatic disc, the arm provided with features to capture the thermostatic disc disposed at a location along the length of the thermostatic disc and spaced along said length from the stationary electrical contact so that the disc coupling member will move with the disc, a blade movably mounted in the housing and a spring disposed in the housing placing a bias on the blade against the disc coupling member when the disc is in a contacts engaged position, the blade being movable under at least a portion of the first leg when the disc moves to a contacts disengaged position to prevent the first leg from moving back to the engaged contacts position, and a reset mechanism mounted in the housing for moving the blade from under the first leg of the disc coupling member.

2. A thermal circuit breaker according to claim 1 in which the blade is pivotally mounted and the reset mechanism comprises a reset lever connected to the blade for manually pivoting the blade against the bias thereon and away from under the first leg of the disc coupling member to allow the movable contact to move into electrical engagement with the stationary contact.

3. A thermal circuit breaker according to claim 1 in which the said features comprise two pairs of spaced apart fingers arranged to extend respectively over and under opposed sides of the thermostatic disc.

4. A thermal circuit breaker according to claim 3 in which the fingers are generally aligned with the position of the movable contact on the thermostatic disc.

5. A thermal circuit breaker according to claim 1 further comprising an actuation component mounted in the housing and movable against the disc coupling member on a side of the pivot opposite from the side of said location of features used for capturing the thermostatic disc to thereby cause the movable contact to move out of engagement with the stationary contact.

6. A thermal circuit breaker according to claim 5 in which said component is a pushbutton.

7. A thermal circuit breaker comprising:

a housing, a stationary electrical contact, a cantilever mounted thermostatic disc having a length and having a free end, a movable electrical contact mounted on the free end of the thermostatic disc and movable into and out of engagement with the stationary contact, a disc coupling member having a pivot for pivotally mounting the disc coupling member in the housing above the thermostatic disc, the disc coupling member having a first leg extending away from the pivot toward the free end of the thermostatic disc in a first direction aligned with the length of the thermostatic disc, an arm depending downwardly from the disc coupling member on the first direction side of the disc coupling member toward the thermostatic disc and formed with a motion transfer surface that extends under and over the thermostatic disc so that the disc coupling member will move with the disc, the disc coupling member having a second leg extending away from the pivot in a second direction opposite to the first direction, a component mounted in the housing and movable against the second leg to cause the disc coupling member to pivot with the first leg moving upwardly and transferring motion through the motion transfer surface to the thermostatic disc to thereby cause the movable contact to move out of engagement with the stationary contact, a blade movably mounted in the housing and biased against the disc coupling member and movable under at least a portion of the first leg to prevent the first leg from moving back to the engaged contact position, and a reset mechanism mounted in the housing for moving the blade from under the first leg.

8. A thermal circuit breaker according to claim 7 in which the said component is a pushbutton.

9. A thermal circuit breaker according to claim 7 in which the motion transfer surface comprises two pairs of spaced apart fingers arranged to extend respectively over and under opposed sides of the thermostatic disc.

10. A thermal circuit breaker according to claim 9 in which the fingers are generally aligned with the position of the movable contact on the thermostatic disc along the length of the disc.

* * * * *